US010323874B2

(12) United States Patent
Mitchell

(10) Patent No.: US 10,323,874 B2
(45) Date of Patent: Jun. 18, 2019

(54) ATTACHMENT SYSTEM FOR AN ICE MAKER

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 155 days.

(21) Appl. No.: 15/423,638

(22) Filed: Feb. 3, 2017

(65) Prior Publication Data

US 2018/0224184 A1 Aug. 9, 2018

(51) Int. Cl.

| | |
|---|---|
| ***F25C 1/00*** | (2006.01) |
| ***F25C 1/24*** | (2018.01) |
| ***F25D 23/04*** | (2006.01) |
| ***F25D 23/06*** | (2006.01) |
| ***F25D 17/06*** | (2006.01) |
| ***F25D 23/02*** | (2006.01) |

(52) U.S. Cl.

CPC ..... *F25D 17/065* (2013.01); *F25C 1/00* (2013.01); *F25C 1/24* (2013.01); *F25D 23/028* (2013.01); *F25D 23/04* (2013.01); *F25D 23/067* (2013.01); *F25C 2400/10* (2013.01); *F25D 2317/061* (2013.01); *F25D 2317/062* (2013.01)

(58) Field of Classification Search

CPC ..... F25C 1/00; F25C 2400/10; F25D 23/04; F25D 23/028; F25D 2317/061; F25D 2317/062

See application file for complete search history.

(56) References Cited

U.S. PATENT DOCUMENTS

| | | | | |
|---|---|---|---|---|
| 8,397,532 | B2 | 3/2013 | Mitchell et al. | |
| 9,377,233 | B2 | 6/2016 | Boehringer et al. | |
| 2011/0203305 | A1* | 8/2011 | Schenk | F25C 1/08 62/344 |
| 2014/0150487 | A1 | 6/2014 | Boarman | |
| 2017/0248348 | A1* | 8/2017 | Kim | F25B 41/067 |
| 2017/0321942 | A1* | 11/2017 | Sherman | F25C 1/04 |

* cited by examiner

*Primary Examiner* — Elizabeth J Martin
(74) *Attorney, Agent, or Firm* — Dority & Manning, P.A.

(57) ABSTRACT

An ice making assembly for a refrigerator appliance is provided. The ice making assembly includes an icebox defining an ice making chamber and a heat exchanger aperture. The icebox is mounted to a refrigerator door and surrounded by a door liner defining a circulation duct for receiving cooled airflow. A heat exchanger is positioned within the heat exchanging aperture and includes a first side positioned within the ice making chamber and a second side positioned outside the ice making chamber within the circulation duct. An icemaker is positioned within the ice making chamber and a fastener removably attaches the icemaker to the first side of the heat exchanger.

20 Claims, 11 Drawing Sheets

ATTACHMENT SYSTEM FOR AN ICE MAKER

FIELD OF THE INVENTION

The present subject matter relates generally to ice making appliances and/or refrigeration appliances including features for making ice.

BACKGROUND OF THE INVENTION

Certain refrigerator appliances utilize sealed systems for cooling chilled chambers of the refrigerator appliances. A typical sealed system includes an evaporator and a fan, the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Certain refrigerator appliances use cooled air from the sealed system to cool an ice making assembly to a temperature sufficient for producing and storing ice. For example, certain refrigerator appliances have an icemaker mounted within an icebox on the door of the refrigerator appliance. The icebox may be in thermal communication with a heat exchanger which is in fluid communication with cooled airflow from the sealed system. The icemaker is mounted to the heat exchanger such that the heat exchanger provides direct conductive cooling to the icemaker. However, icemakers typically require frequent service and/or maintenance, and removal of the icemaker from the heat exchanger is frequently complicated, laborious, and time-consuming.

Accordingly, a refrigerator appliance including an ice making assembly having one or more features for simplifying maintenance would be useful. More particularly, an ice making assembly including an attachment system that makes removal and installation of the icemaker quick and easy would be especially beneficial.

BRIEF DESCRIPTION OF THE INVENTION

An ice making assembly for a refrigerator appliance is provided. The ice making assembly includes an icebox defining an ice making chamber and a heat exchanger aperture. The icebox is mounted to a refrigerator door and surrounded by a door liner defining a circulation duct for receiving cooled airflow. A heat exchanger is positioned within the heat exchanging aperture and includes a first side positioned within the ice making chamber and a second side positioned outside the ice making chamber within the circulation duct. An icemaker is positioned within the ice making chamber and a fastener removably attaches the icemaker to the first side of the heat exchanger. Additional aspects and advantages of the invention will be set forth in part in the following description, or may be apparent from the description, or may be learned through practice of the invention.

In accordance with one embodiment, an ice making assembly for a refrigerator appliance is provided. The ice making assembly includes an icebox defining an ice making chamber and a heat exchanger aperture. A heat exchanger is positioned within the heat exchanger aperture, the heat exchanger including a first side positioned within the ice making chamber and a second side positioned outside the ice making chamber. A circulation duct is in fluid communication with the second side of the heat exchanger and configured for circulating cooled air over the second side of the heat exchanger. An icemaker is positioned within the ice making chamber and a fastener removably attaches the icemaker to the first side of the heat exchanger.

In accordance with another embodiment, a refrigerator appliance is provided. The refrigerator appliance includes a cabinet defining a chilled chamber and a door being rotatably mounted to the cabinet to provide selective access to the chilled chamber. A door liner is attached to the door and defines a circulation duct configured for receiving cooled air from a sealed system. An ice making assembly includes an icebox mounted within the door liner, the icebox defining an ice making chamber and a heat exchanger aperture. A heat exchanger is positioned within the heat exchanger aperture, the heat exchanger including a first side positioned within the ice making chamber and a second side positioned outside the ice making chamber and in fluid communication with the circulation duct. An icemaker is positioned within the ice making chamber and a fastener removably attaches the icemaker to the first side of the heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
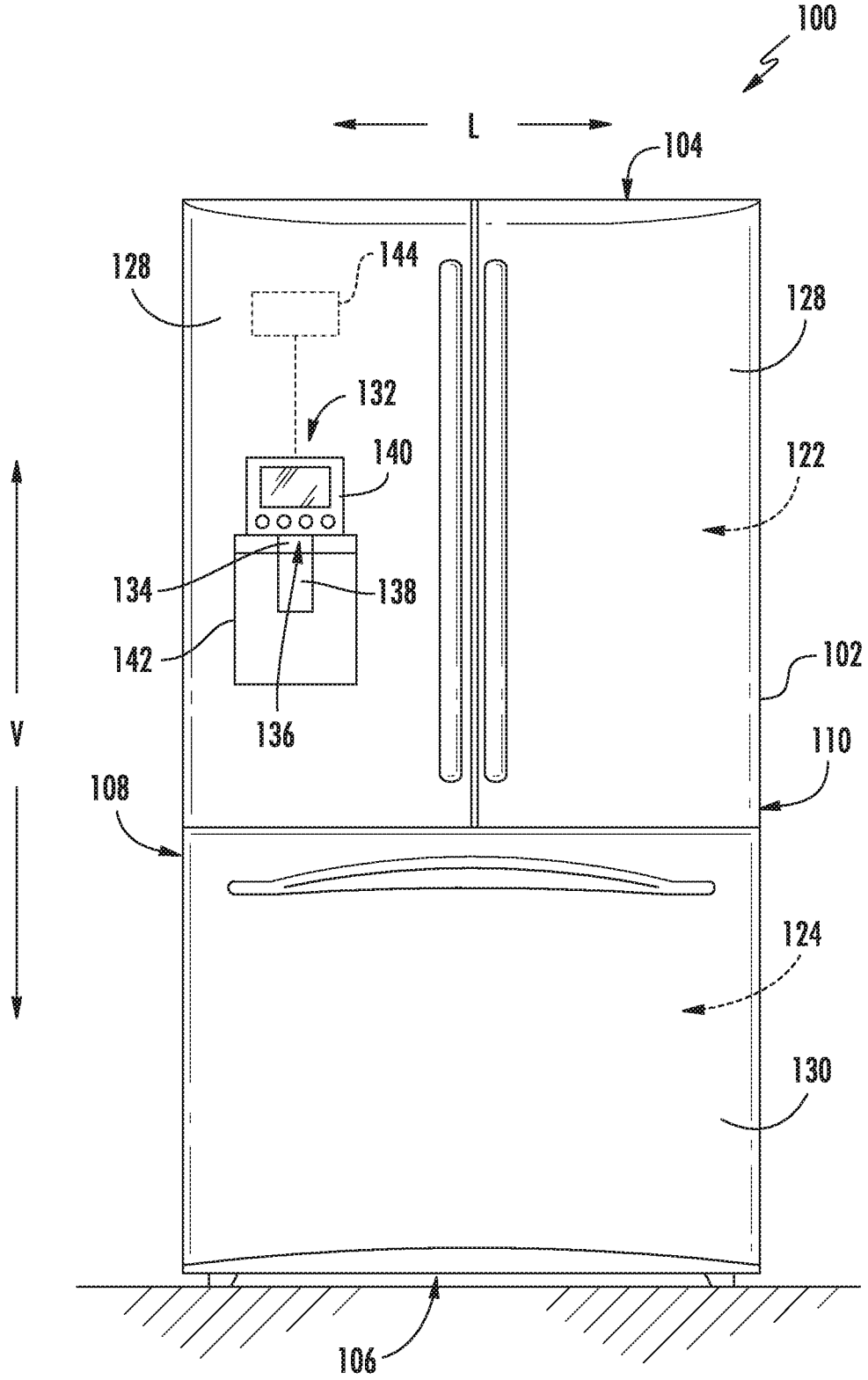
FIG. 1 provides a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
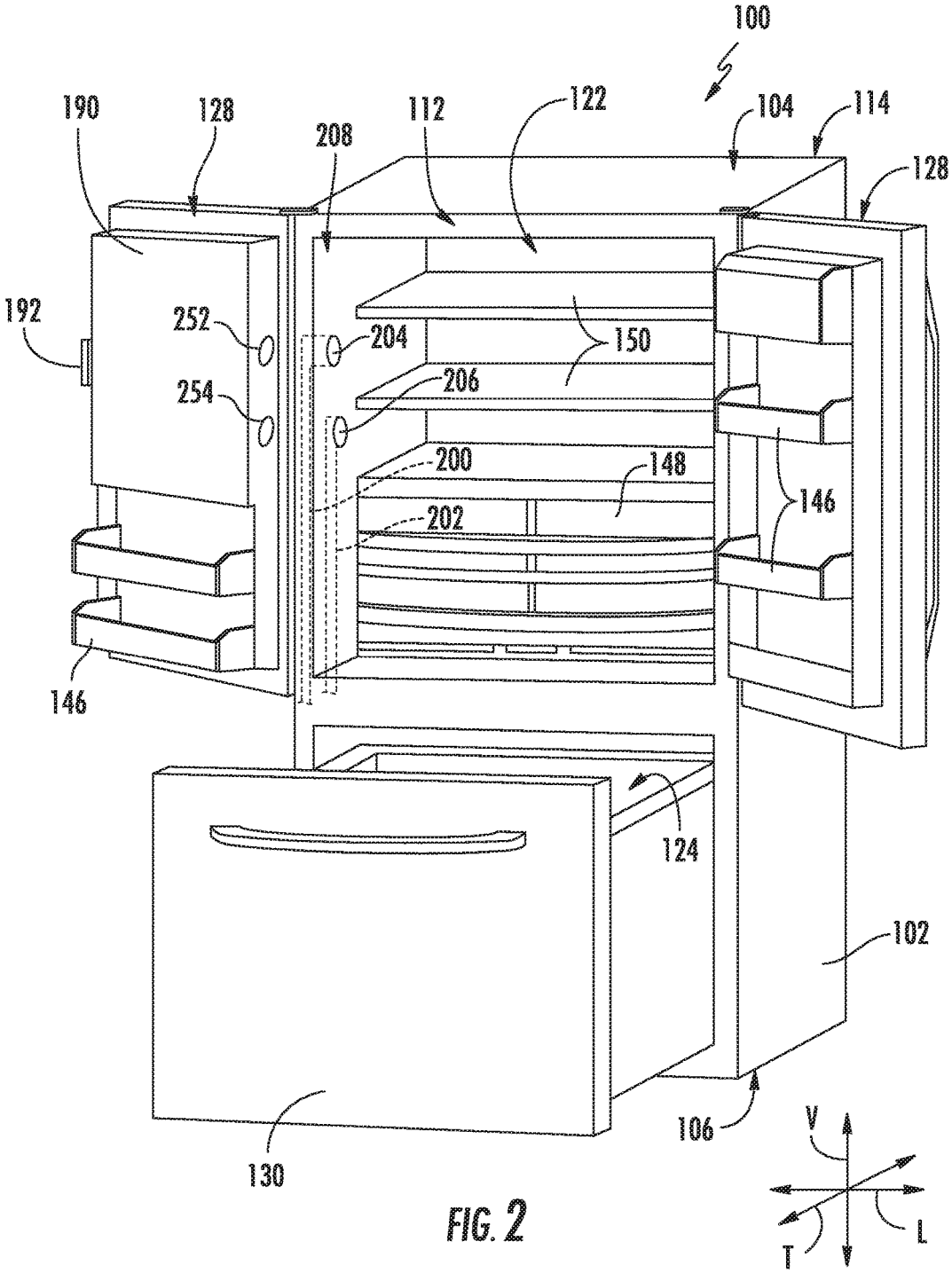
FIG. 2 provides a front perspective view of the exemplary refrigerator appliance of FIG. 1 with refrigerator doors and freezer doors shown in an open configuration to reveal a fresh food chamber and freezer chamber.

FIG. 1 provides a front view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T (FIG. 2). Each of the vertical direction V, the lateral direction L, and the transverse direction T are mutually perpendicular to one another.

Housing 102 defines chilled chambers for receipt of food items for storage. In particular, housing 102 defines a fresh food chamber 122 positioned at or adjacent top 104 of housing 102 and a freezer chamber 124 arranged at or adjacent bottom 106 of housing 102. As such, refrigerator appliance 100 is generally referred to as a "bottom mount" refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. It should be noted that while refrigerator doors 128 are illustrated in a "French door" configuration, any suitable number, type, and orientation of doors may be used according to alternative embodiments. In addition, freezer doors 130 are arranged below refrigerator doors 128 for selectively accessing freezer chamber 124. Freezer doors 130 are coupled to freezer drawers (not shown) that are slidably mounted within freezer chamber 124. To prevent leakage of cool air, refrigerator doors 128, freezer doors 130, and/or housing 102 may include one or more sealing mechanisms (e.g., rubber gaskets, not shown) at the interface where the doors 128, 130 meet housing 102. It should be appreciated that doors having a different style, position, or configuration are possible and within the scope of the present subject matter.

Refrigerator appliance 100 also includes a dispensing assembly 132 for dispensing liquid water and/or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the exemplary embodiment, dispenser recess 142 is positioned at a level that approximates the chest level of a user. According to an exemplary embodiment, the dispensing assembly 132 may receive ice from an icemaker disposed in a sub-compartment of the fresh food chamber 122.

Refrigerator appliance 100 further includes a controller 144. Operation of the refrigerator appliance 100 is regulated by controller 144 that is operatively coupled to a control panel 140. In one exemplary embodiment, control panel 140 may represent a general purpose I/O ("GPIO") device or functional block. In another exemplary embodiment, control panel 140 may include input components, such as one or more of a variety of electrical, mechanical or electromechanical input devices including rotary dials, push buttons, touch pads, and touch screens. Control panel 140 may be in communication with controller 144 via one or more signal lines or shared communication busses. Control panel 140 provides selections for user manipulation of the operation of refrigerator appliance 100. In response to user manipulation of control panel 140, controller 144 operates various components of refrigerator appliance 100. For example, controller 144 is operatively coupled or in communication with various components of a sealed system, as discussed below. Controller 144 may also be in communication with a variety of sensors, such as, for example, chamber temperature sensors or other sensors. Controller 144 may receive signals from these temperature sensors that correspond to the temperature of an atmosphere.

Controller 144 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 144 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

FIG. 2 is a perspective view of refrigerator appliance 100 having refrigerator doors 128 and freezer door 130 in an open position to reveal the interior of the fresh food chamber 122 and freezer chamber 124. According to the illustrated embodiment, various storage components are mounted within fresh food chamber 122 and freezer chamber 124 to facilitate storage of food items therein as will be understood by those skilled in the art. In particular, the storage components include bins 146, drawers 148, and shelves 150 that are mounted within fresh food chamber 122 or freezer chamber 124. Bins 146, drawers 148, and shelves 150 are configured for receipt of food items (e.g., beverages and/or solid food items) and may assist with organizing such food items. As an example, drawers 148 can receive fresh food items (e.g., vegetables, fruits, and/or cheeses) and increase the useful life of such fresh food items.

Figure 3:
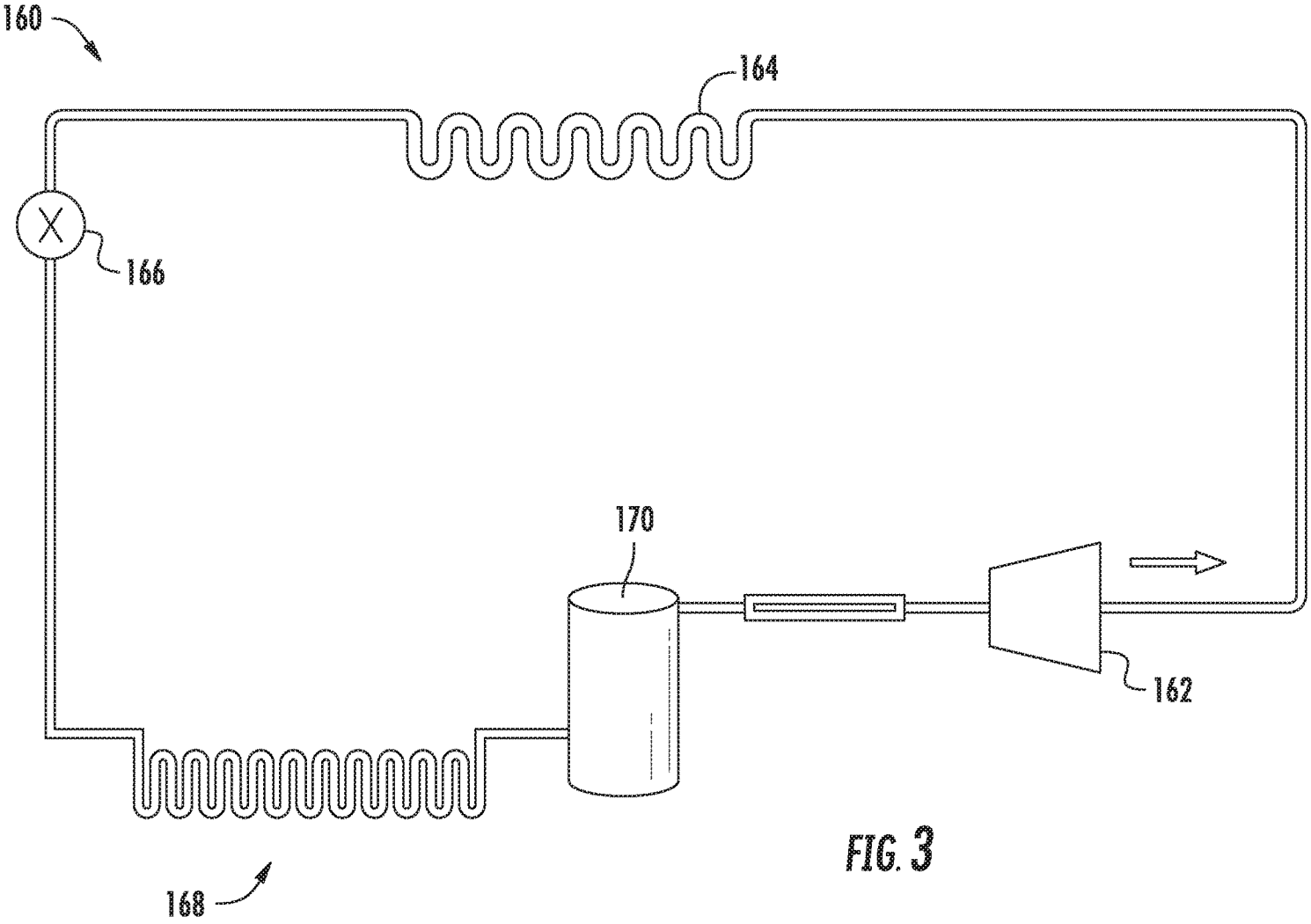
FIG. 3 provides a schematic view of a sealed cooling system configured for cooling the exemplary refrigerator appliance of FIG. 1 according to an exemplary embodiment of the present subject matter.

Referring now to FIG. 3, a schematic view of an exemplary sealed system 160 which may be used to cool fresh food chamber 122 and freezer chamber 124 will be described. Sealed system 160 is generally configured for executing a vapor compression cycle for cooling air within refrigerator appliance 100, e.g., within fresh food chamber 122 and freezer chamber 124. Sealed cooling system 160 includes a compressor 162, a condenser 164, an expansion device 166, and an evaporator 168 connected in series and charged with a refrigerant.

During operation of sealed system 160, gaseous refrigerant flows into compressor 162, which operates to increase the pressure of the refrigerant. This compression of the refrigerant raises its temperature, which is lowered by passing the gaseous refrigerant through condenser 164. Within condenser 164, heat exchange with ambient air takes place so as to cool the refrigerant and cause the refrigerant to condense to a liquid state.

Expansion device (e.g., a valve, capillary tube, or other restriction device) 166 receives liquid refrigerant from condenser 164. From expansion device 166, the liquid refrigerant enters evaporator 168. Upon exiting expansion device 166 and entering evaporator 168, the liquid refrigerant drops in pressure and vaporizes. Due to the pressure drop and phase change of the refrigerant, evaporator 168 is cool relative to fresh food chamber 122 and freezer chamber 124 of refrigerator appliance 100. As such, cooled air is produced and refrigerates fresh food chamber 122 and freezer chamber 124 of refrigerator appliance 100. Thus, evaporator 168 is a type of heat exchanger which transfers heat from air passing over evaporator 168 to refrigerant flowing through evaporator 168.

It should be appreciated that the illustrated sealed system 160 is only one exemplary configuration of sealed system 160 which may include additional components, e.g., one or more additional evaporators, compressors, expansion devices, and/or condensers. As an example, sealed cooling system 160 may include two evaporators. As a further example, sealed system 160 may further include an accumulator 170. Accumulator 170 may be positioned downstream of evaporator 168 and may be configured to collect condensed refrigerant from the refrigerant stream prior to passing it to compressor 162. Furthermore, according to the exemplary embodiment, housing 102 may define a mechanical compartment (not shown) for housing various components of sealed system 160.

Figure 4:
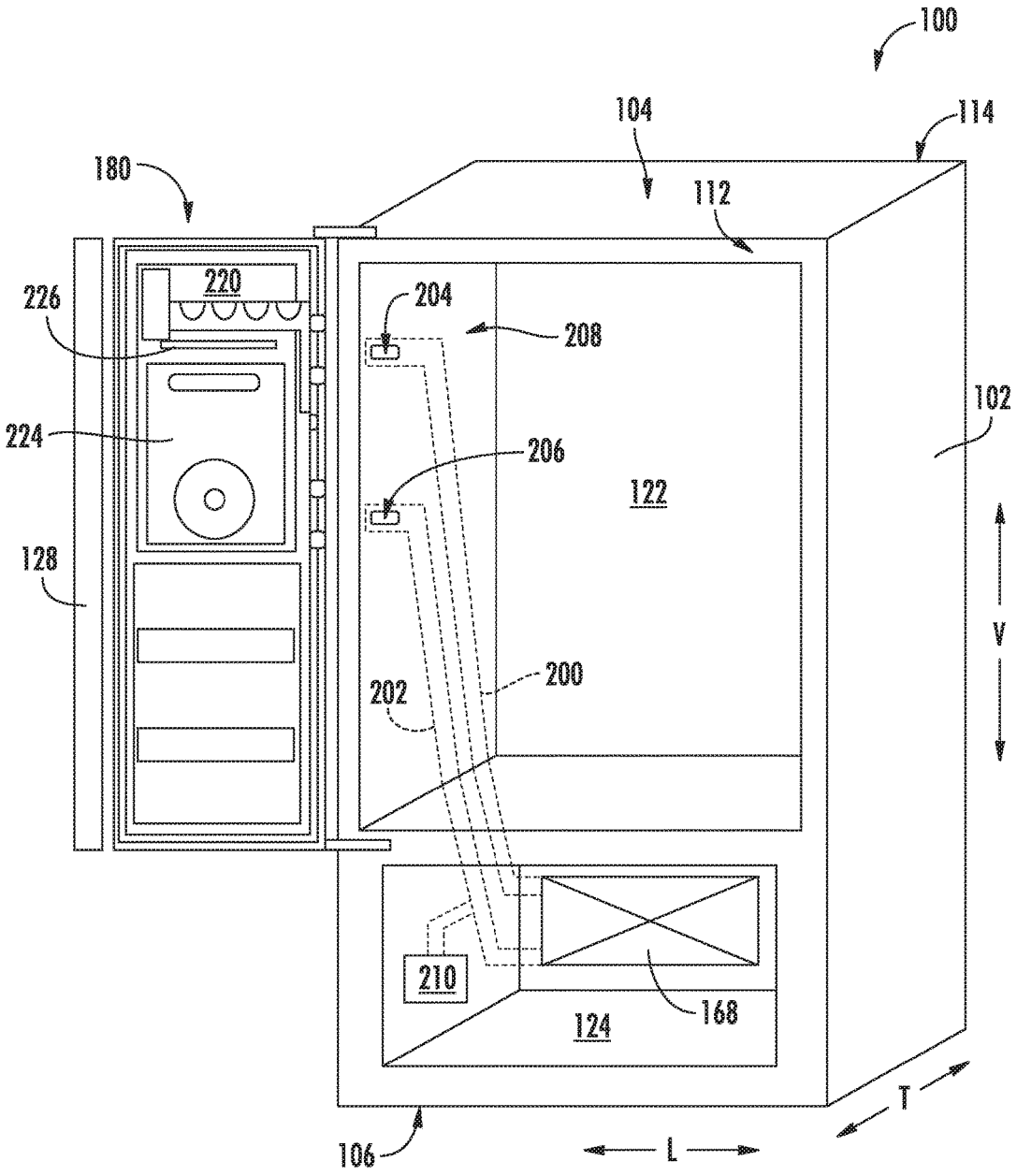
FIG. 4 provides a partial schematic view of a sealed cooling system and an ice making assembly in a refrigerator door of the exemplary refrigerator appliance of FIG. 1 according to an exemplary embodiment of the present subject matter.
Figure 5:
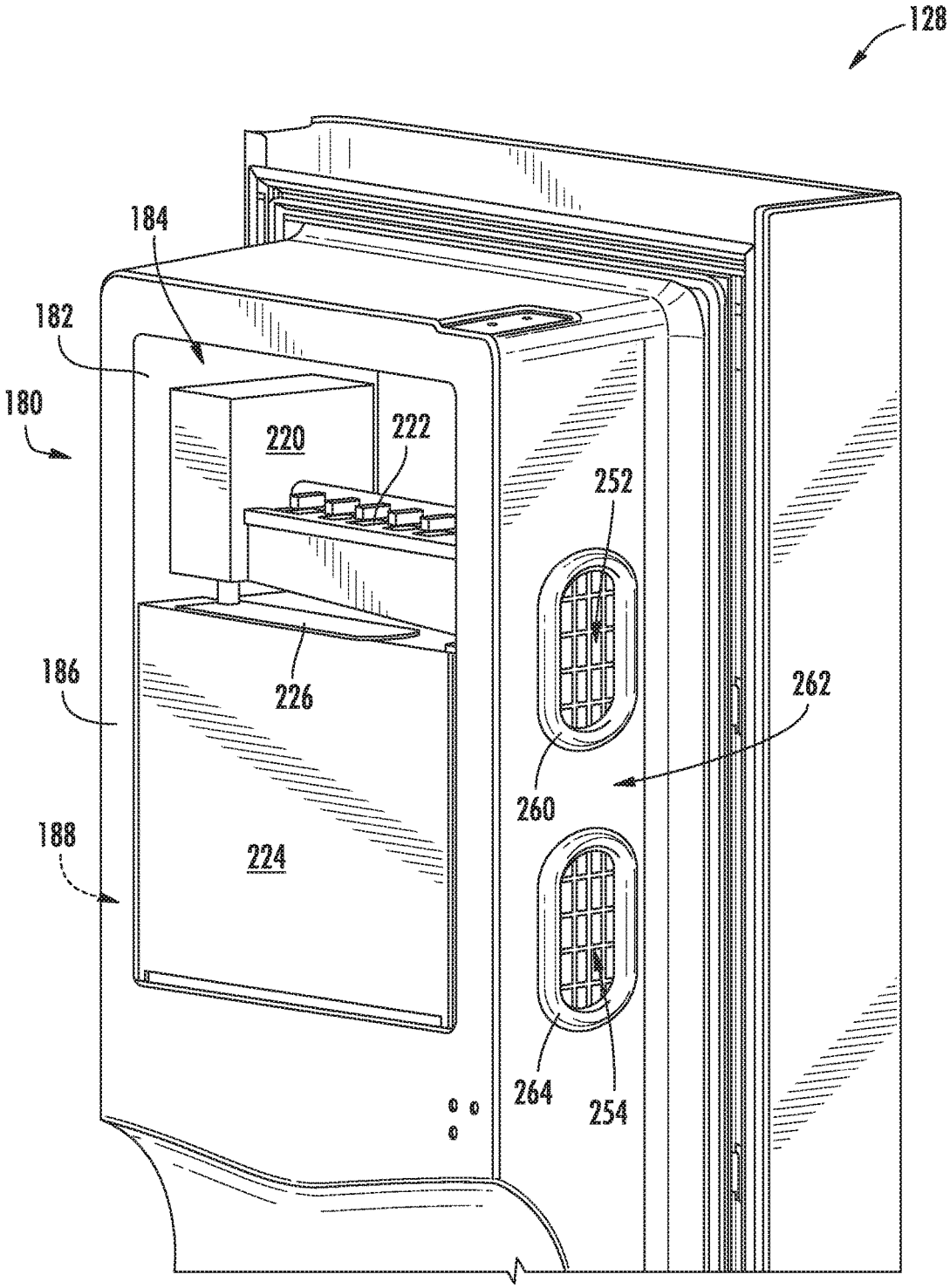
FIG. 5 provides a perspective view of the exemplary refrigerator door and ice making assembly of FIG. 4.
Figure 6:
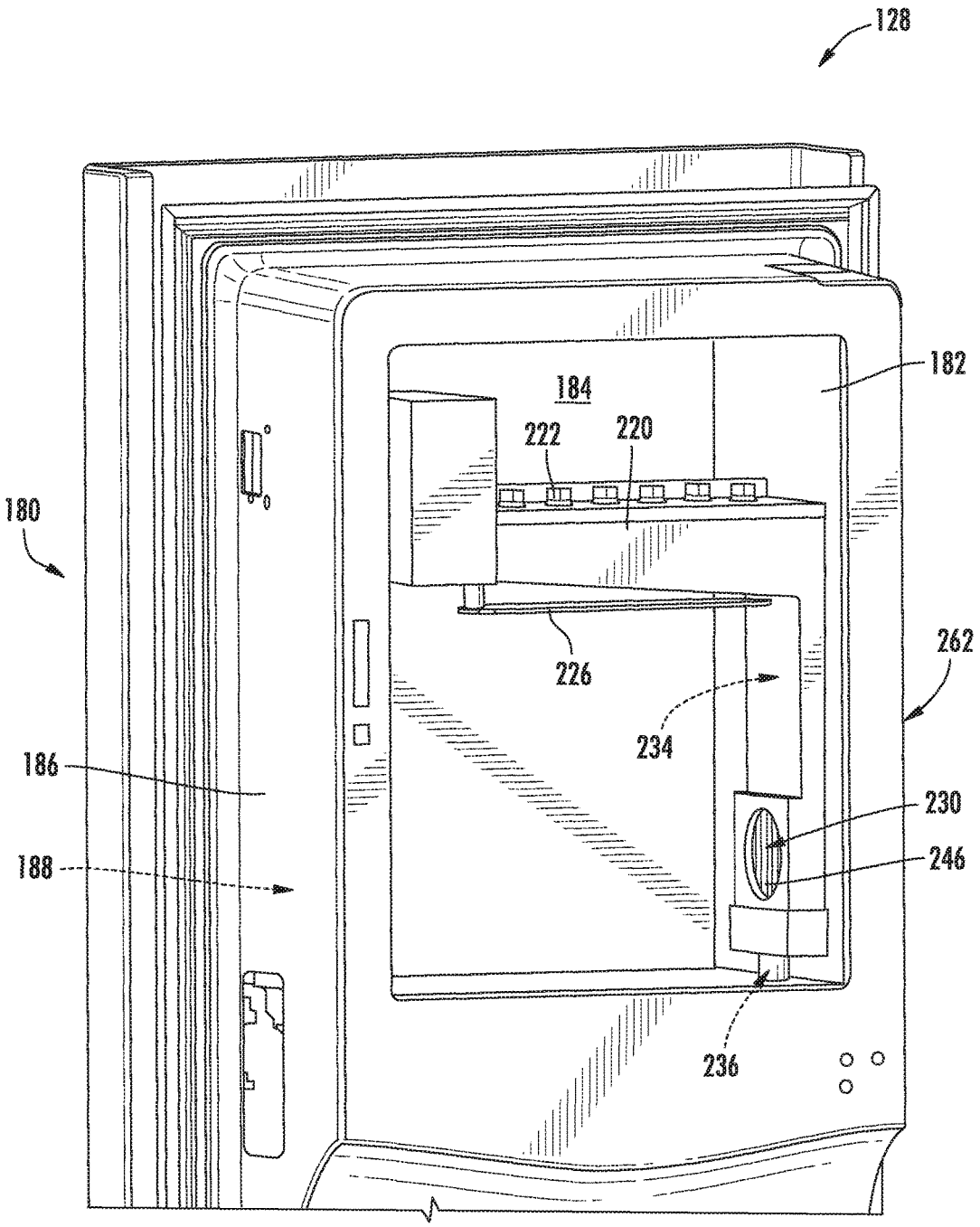
FIG. 6 provides another perspective view of the exemplary refrigerator door and ice making assembly of FIG. 4.
Figure 7:
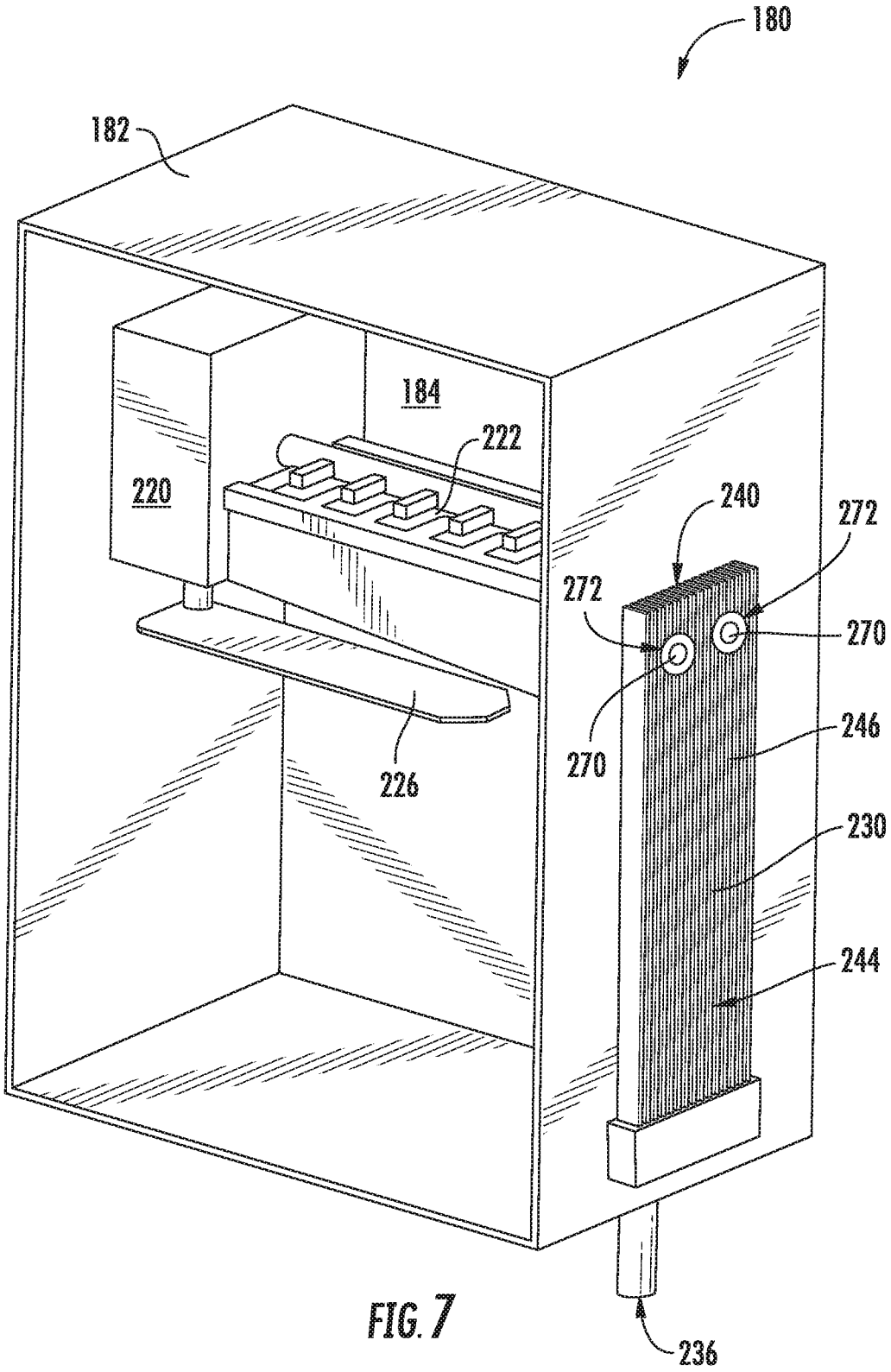
FIG. 7 provides a perspective view of an icebox of the exemplary ice making assembly of FIG. 4 with a door liner and other components removed for clarity.
Figure 8:
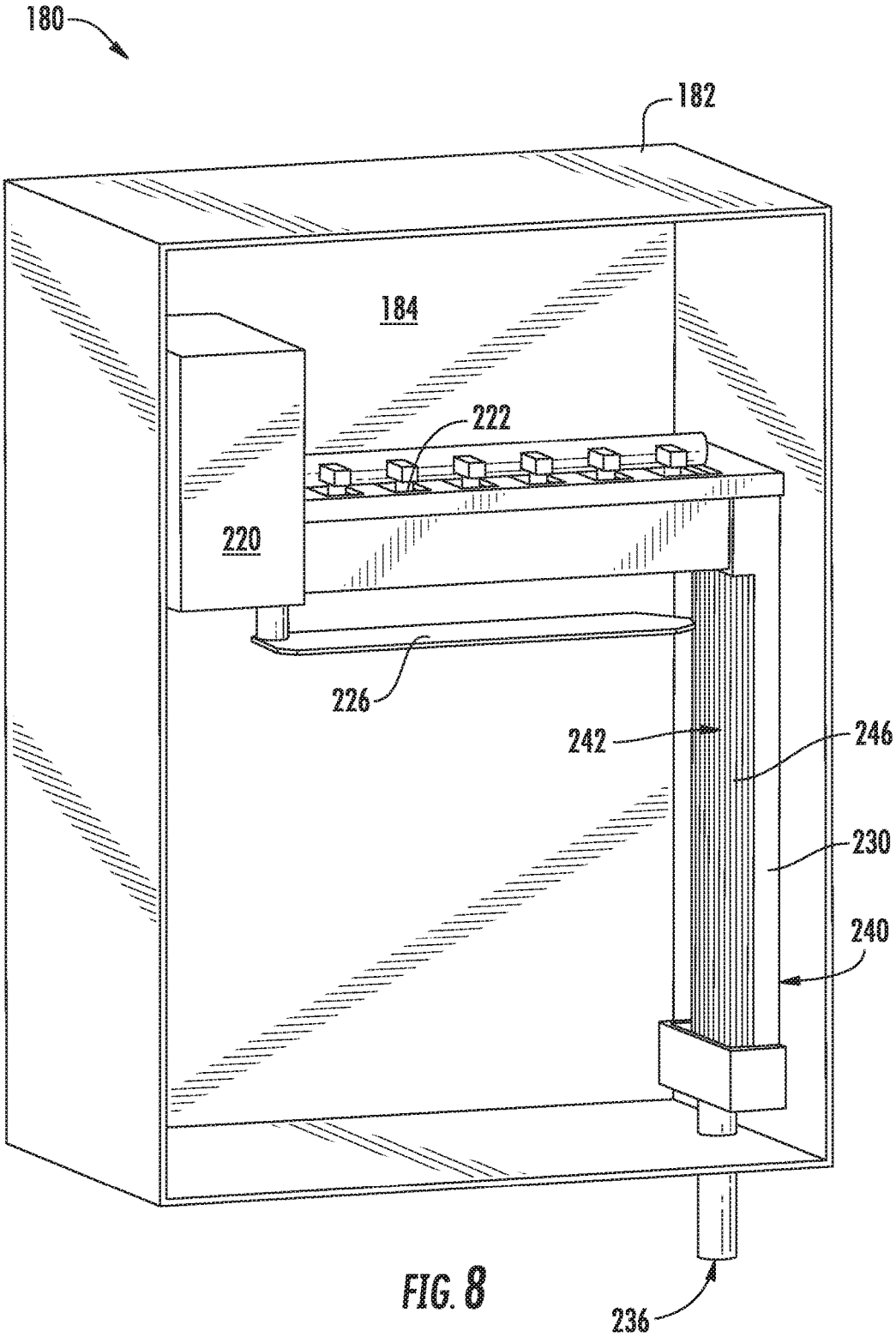
FIG. 8 provides another perspective view of the icebox of the exemplary ice making assembly of FIG. 4 with the door liner and other components removed for clarity.

Referring now to FIG. 4, an ice making assembly 180 will be described according to an exemplary embodiment of the present subject matter. As illustrated, ice making assembly 180 may be positioned outside of freezer chamber 124 and proximate to fresh food chamber 122, e.g., in one of refrigerator doors 128. More specifically, ice making assembly 180 may include an icebox 182 that defines an ice making chamber 184 which contains many of the working components of ice making assembly 180. According to the illustrated embodiment, refrigerator door 128 includes a door liner 186 which is configured for receiving icebox 182. However, according to alternative embodiment, icebox 182 could be mounted directly to refrigerator door 128. Notably, ice making assembly 180 may be disposed at least partially within the fresh food chamber 122 when refrigerator door 128 is in the closed position.

According to an exemplary embodiment, door liner 186 may be an injection-molded liner attached to an inside of refrigerator door 128. Insulation 188, such as expandable foam can be present between refrigerator door 128 and door liner 186 in order to assist with thermally insulating ice making chamber 184. For example, sprayed polyurethane foam may be injected into a cavity defined between refrigerator door 128 and door liner 186 after they are assembled. In addition, referring again to FIG. 2, some exemplary embodiments may include an access door—e.g., icebox door 190—which may be hinged to icebox 182 to selectively cover or permit selective access to ice making chamber 184. A latch 192 or any other suitable securing mechanism may be provided on icebox 182 or door liner 186 to maintain icebox door 190 in a closed position. In some exemplary embodiments, latch 192 may be actuated by a consumer in order to open icebox door 190 for providing access into ice making chamber 184. In exemplary embodiments which include icebox door 190, insulation 188 is provided throughout icebox door 190 for thermally isolating or insulating ice making chamber 184 from fresh food chamber 122.

As illustrated in FIG. 4, to maintain the temperature of ice making chamber 184 at a temperature sufficient forming and storing ice, ice making assembly 180 may be in thermal communication with freezer chamber 128 or sealed system 160. For example, according to the illustrated embodiment, ice making assembly 180 may be in fluid communication with evaporator 168 of sealed system 160 which may be disposed in or near the freezer chamber 124. In some embodiments, a supply duct 200 and a return duct 202 may extend between and provide the thermal communication between ice making assembly 180 and evaporator 168. Supply duct 200 may include supply outlet 204 for supplying cooled air and return duct 202 may include a return inlet 206 for recirculating air to evaporator 168. As illustrated, both supply outlet 204 and return inlet 206 are defined on an interior wall 208 of fresh food chamber 122, but could be positioned elsewhere according to alternative embodiments.

Ducts 200 and 202 may generally be disposed within the refrigerator appliance 100, such as within the various walls defining the chambers 122, 124. In some exemplary embodiments, the ducts 200 and 202 may be foamed in place within the various walls of the refrigerator appliance 100. According to the illustrated embodiment, fluid communication between evaporator 168 and ice making assembly 180 may be enhanced by various air movers, such as a blower or fan 210, connected to one or the other of supply duct 200 and return duct 202.

Referring now generally to FIGS. 5 through 8, ice making assembly 180 may include an icemaker 220 positioned within ice making chamber 184. In some exemplary embodiments, icemaker 220 may include a mold body 222 configured for receiving liquid water and forming ice in mold body 222. For example, mold body 222 may define a series of impressions or recesses which receive liquid water therein and hold the liquid water at least until the liquid water freezes.

According to the illustrated embodiment, icemaker 220 further includes features for harvesting the ice from mold body 222 once it has been formed, as well as features for storing and/or dispensing the harvested ice. For example, ice making assembly 180 may also include an ice storage bin 224 disposed proximate mold body 222, e.g., below mold body 222, for receipt and storage of ice once the ice has been formed in mold body 222. In some embodiments, a level sensor 226, such as an optical sensor or sweep arm, may be provided to sense when the level of ice in storage bin 224 reaches or nears a maximum fill level of the storage bin 224.

Mold body 222 may also be in thermal communication with a harvest heater 228 (FIG. 9), such as an electric resistance heating element. Harvest heater 228 may be positioned near a bottom portion of mold body 222 and may be attached to or embedded in mold body 222. In some embodiments, harvest heater 228 may be configured to at least partially heat and/or defrost mold body 222, e.g., to release ice formed within the impressions or recesses of mold body 222. Similarly, harvest heater 228 may be configured to at least partially heat and/or defrost a heat exchanger 230. Ice making assembly 180 may further include a drain conduit 234 and a drain port 236. More specifically, drain conduit 234 may be configured for collecting and conveying water melted from mold body 222 and/or heat exchanger 230 to drain port 236, where it may be discharged from ice making assembly 180.

Figure 9:
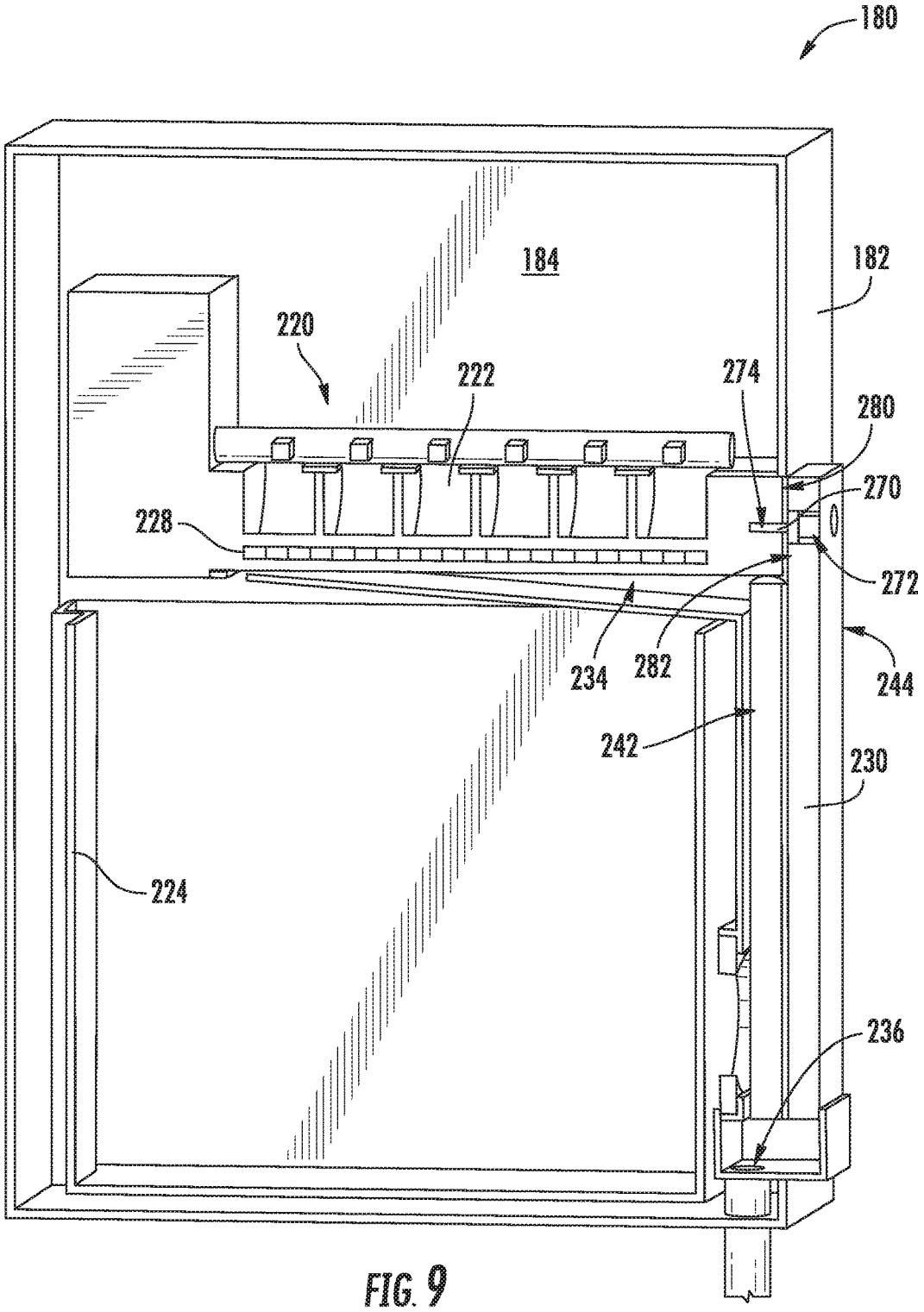
FIG. 9 provides cross sectional view of the icebox of the exemplary ice making assembly of FIG. 4 with the door liner and other components removed for clarity.
Figure 10:
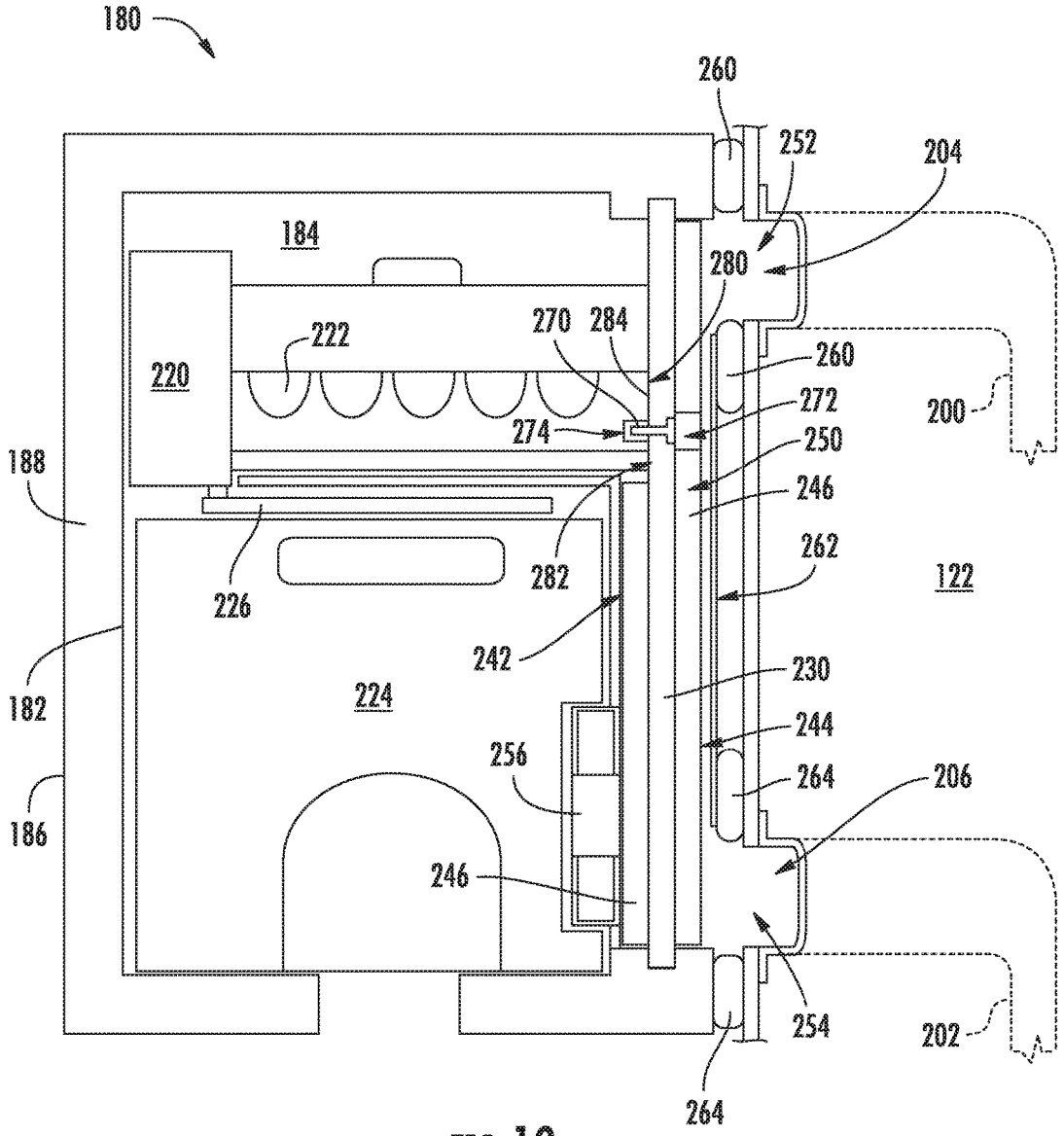
FIG. 10 provides a schematic front view of the exemplary ice making assembly of FIG. 4 according to an exemplary embodiment of the present subject matter.
Figure 11:
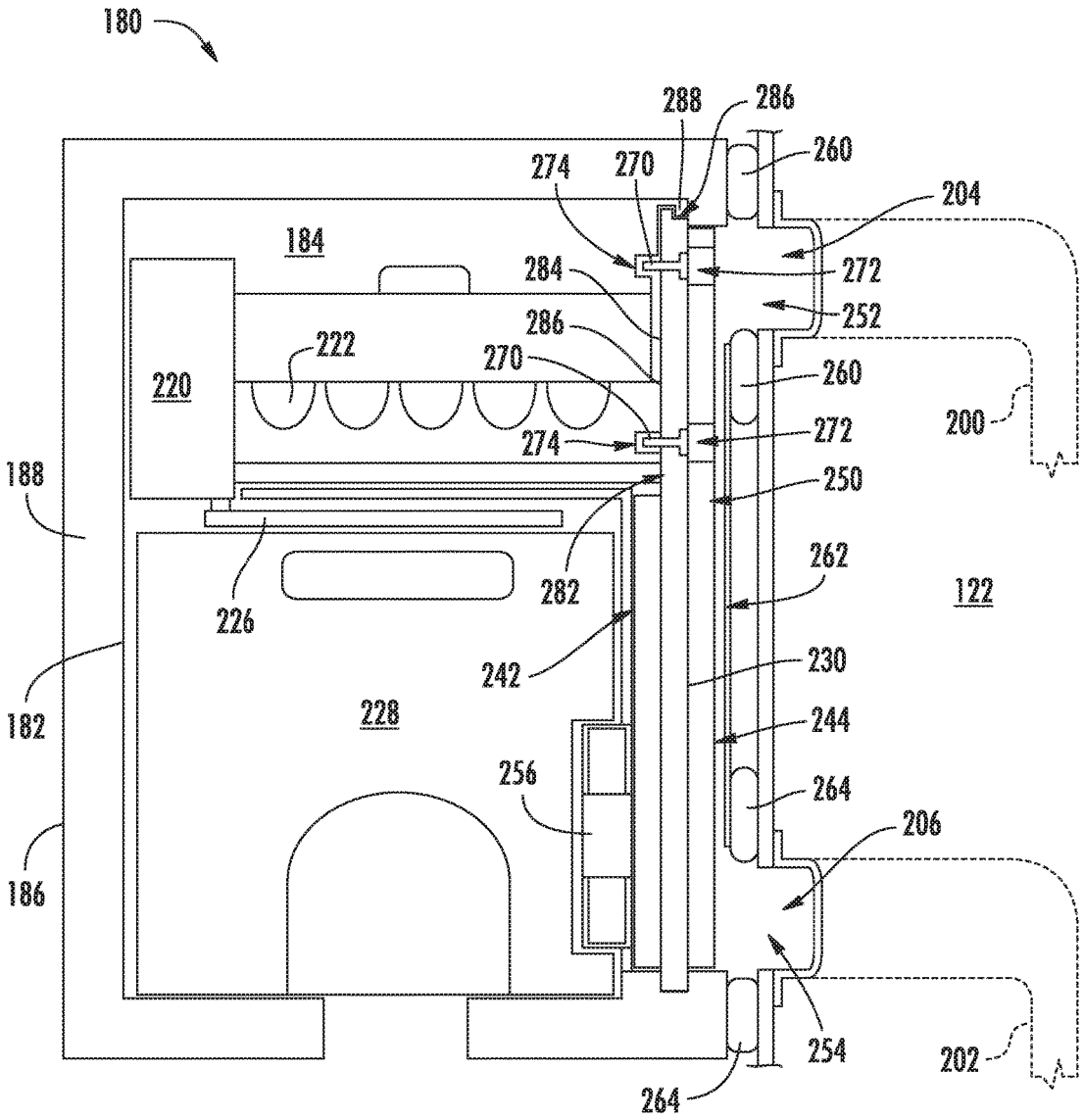
FIG. 11 provides a schematic front view of the exemplary ice making assembly of FIG. 4 according to another exemplary embodiment of the present subject matter.

Referring now to FIGS. 9 through 11, ice making assembly 180 will be described in more detail. As explained above, icebox 182 defines ice making chamber 184. In addition, icebox 182 defines a heat exchanger aperture 240 configured for receiving heat exchanger 230. More specifically, heat exchanger aperture 240 is defined in a side of icebox 182 and is sized to securely receive heat exchanger 230. According to an exemplary embodiment, heat exchanger 230 may be secured in heat exchanger aperture 240 in a fluid tight manner, e.g., using a mechanical fastener and a seal or by providing foamed insulation around heat exchanger 230 to fix it in place.

Heat exchanger 230 includes a first side 242 positioned within ice making chamber 184, a second side 244 positioned outside ice making chamber 184, and a solid wall positioned therebetween. Heat exchanger 230 may be constructed of any thermally conductive material, e.g., metal, and may define a plurality of heat exchanging fins 246 to enhance heat transfer. According to an exemplary embodiment, ice making assembly 180 may further include a circulation duct 250 in fluid communication with second side 244 of heat exchanger 230 and configured for circulating cooled air over second side 244 of heat exchanger 230. According to the illustrated embodiment, circulation duct 250 is defined at least in part by door liner 186, heat exchanger 230, and/or icebox 182. In this manner, insulation 188 may surround circulation duct 250. However, according to alternative embodiments, a dedicated duct or conduit may be used to circulate cooling air across heat exchanger 230.

As best shown in FIGS. 10 and 11, circulation duct 250 defines an inlet 252 and an outlet 254 for placing circulation duct 250 in fluid communication with evaporator 168. More specifically, when refrigerator door 128 is in the closed positioned, inlet 252 is in direct fluid communication with supply duct 200 through supply outlet 204 and outlet 254 is in direct fluid communication with return duct 202 through return inlet 206. Thus, according to the exemplary embodiment, fan 210 may urge cooled air from evaporator 168 (or freezer chamber 124) through supply duct 200, into circulation duct 250, and back to evaporator 168 through return duct 202.

Although cooled air is supplied to circulation duct 250, according to the illustrated embodiment, ice making chamber 184 is not in direct fluid communication with the circulation duct 250. In other words, in such embodiments, ice making chamber 184 may be isolated from circulation duct 250 and sealed system 160. Instead, for example, thermal communication between ice making assembly 180 and evaporator 168 may be by convection, i.e., air flow, from evaporator 168 to heat exchanger 230 and by conduction from heat exchanger 230 to mold body 222 in ice making chamber 184. In addition, ice making assembly 180 may include a fan 256 for urging a flow of air over first side 242 of heat exchanger 230 and toward mold body 222.

Providing cold air from evaporator 168 to heat exchanger 230 rather than directly into ice making chamber 184 may permit more efficient thermal energy transfer from the cold air to mold body 222. That is, rather than circulating cold air above mold body 222, placing mold body 222 in direct contact (and thus direct conductive thermal communication) with heat exchanger 230 and urging a flow of cold air over heat exchanger 230 and onto mold body 222 using fan 256 allows the cold air to more directly influence mold body 222. As a result, the ice making assembly 180 may be more efficient and provide faster ice production.

In some embodiments, ice making assembly 180 may further include one or more sealing mechanisms operably coupled with inlet 252 and outlet 254 of circulation duct 250 for reducing or eliminating leakage of cooled airflow between supply duct 200 and circulation duct 250. For example, an inlet gasket 260 may be positioned over inlet 252, e.g., on a mating surface 262 where door liner 186 engages supply outlet 204. Similarly, an outlet gasket 264 may be positioned over outlet 254 on mating surface 262 where door liner 186 engages return inlet 206. Gaskets 260, 264 may enclose their respective openings. In alternative embodiments, gaskets 260, 264 may be positioned on interior wall 208 of fresh food chamber 122 and extend between interior wall 208 and mating surface 262 of door liner 186 when refrigerator door 128 is in the closed position.

Referring still to FIGS. 9 through 11, ice making assembly 180 includes features for attaching icemaker 220 in a manner that makes icemaker 220 easily removable, e.g., for routine service or maintenance. More specifically, icemaker 220 may be removably attached to first side 242 of heat exchanger 230 using one or more fasteners 270. According to the illustrated embodiment, fasteners 270 pass through heat exchanger 230 into icemaker 220. More specifically, according to the illustrated embodiment, heat exchanger 230 may define an aperture 272 configured for receiving fastener 270. In this regard, fastener 270 may be inserted through aperture 272, pass through heat exchanger 230, and be received within a boss 274 defined in icemaker 220, or more specifically, in mold body 222.

Notably, fastener 270 is accessible through circulation duct 250. In this manner, a screwdriver, socket, hand, or other tool may be inserted through inlet 252 or outlet 254 to remove fastener 270 when refrigerator door 128 is in the open position. After fastener 270 is removed, icemaker 220 may be serviced as needed and quickly reinstalled using the reverse process. More specifically, icemaker 220 may be positioned on first side 242 of heat exchanger 230 when refrigerator door 128 is open and fastener 270 may be inserted through aperture 272 into boss 274.

According to the illustrated embodiment, fastener 270 is a bolt or screw. However, it should be appreciated that fastener may be any suitable non-permanent (i.e., removable) mechanical fastener. In addition, any suitable number and orientation of fasteners 270 may be used. For example, as illustrated in FIGS. 7 through 10, two laterally-adjacent fasteners 270 are used. However, in FIG. 11, two vertically-adjacent fasteners 270 are used.

Ice making assembly 180 may further include or define features that further simplify installation of icemaker 220 or further improve the thermal contact between icemaker 220 and heat exchanger 230. For example, according to the illustrated embodiment, icemaker 220 defines a mounting surface 280 and first side 242 of heat exchanger 230 defines a receiving surface 282. Receiving surface 282 may be, for example, a flat spot where heat exchanging fins 246 are omitted. Mounting surface 280 may be a complementary flat surface such that improved thermal contact may be established between the icemaker 220 and heat exchanger 230 when icemaker 220 is installed. Although mounting surface 280 and receiving surface 282 are illustrated as flat surfaces, it should be appreciated that these surfaces may take any shape so long as they are complementary to each other, e.g., they may be curved, staggered, etc. According to still another exemplary embodiment, a thermally conductive paste 284 may be positioned between mounting surface 280 of icemaker 220 and receiving surface 282 of heat exchanger 230 when icemaker 220 is in an installed position.

According to still another embodiment, icemaker 220 and heat exchanger 230 may define complementary alignment features for assisting with the proper alignment of icemaker 220 during installation. For example, as shown in FIG. 11, heat exchanger 230 may define a recess 286 and icemaker 220 may define a complementary protruding member 288. In this manner, an technician may hook protruding member 288 into recess 286 such that icemaker 220 may be temporarily supported while fasteners 270 are inserted. It should be appreciated that other alignment features are possible and within the scope of the present subject matter.

Using the features described above, ice making assembly 180 provides an icemaker 200 that may be efficiently cooled and easily removed for maintenance or service procedures. In addition, the ice making chamber is isolated from the cooling airflow. This prevents the ice within the ice making chamber from adsorbing tastes and/or odors from the food to which the cooling air is exposed. As one skilled in the art will appreciate, the above described embodiments are used only for the purpose of explanation. Modifications and variations may be applied, other configurations may be used, and the resulting configurations may remain within the scope of the invention. For example, ice making assembly 180 may be positioned at other locations within refrigerator appliance 100, different configurations for circulation duct 250 may be used, and different attachment configurations and systems may be used. Such modifications and variations are considered to be within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for a refrigerator appliance, the ice making assembly comprising:

an icebox defining an ice making chamber and a heat exchanger aperture;

a heat exchanger positioned within the heat exchanger aperture, the heat exchanger comprising a first side positioned within the ice making chamber and a second side positioned outside the ice making chamber;

a circulation duct in fluid communication with only the second side of the heat exchanger and configured for circulating cooled air over only the second side of the heat exchanger;

an icemaker positioned within the ice making chamber; and a fastener for removably attaching the icemaker to the first side of the heat exchanger.

2. The ice making assembly of claim 1, wherein the fastener is passed through the heat exchanger into the icemaker.

3. The ice making assembly of claim 1, wherein the ice making assembly comprises two or more fasteners for removably attaching the icemaker to the heat exchanger.

4. The ice making assembly of claim 1, wherein the fastener is a bolt.

5. The ice making assembly of claim 1, wherein the fastener is accessible through the circulation duct.

6. The ice making assembly of claim 1, wherein the icebox is mounted to a refrigerator door of the refrigerator appliance and the circulation duct is defined by a door liner of the refrigerator door.

7. The ice making assembly of claim 1, wherein the icemaker defines a mounting surface and the first side of the heat exchanger defines a receiving surface, the receiving surface being complementary to and configured for receiving the mounting surface of the icemaker.

8. The ice making assembly of claim 7, wherein a thermally conductive paste is positioned between the mounting surface of the icemaker and the receiving surface of the heat exchanger when the icemaker is in an installed position.

9. The ice making assembly of claim 1, wherein the heat exchanger and the icemaker define complementary alignment features for supporting the icemaker while fasteners are inserted.

10. The ice making appliance of claim 1, wherein the heat exchanger is sealed within the heat exchanger aperture such that the circulation duct is not in fluid communication with the ice making chamber.

11. The ice making appliance of claim 1, wherein the refrigerator appliance comprises a supply duct and a return duct for circulating cooled airflow through an evaporator chamber of the refrigerator appliance, and wherein the circulation duct defines an inlet and an outlet, the inlet and the outlet being placed in fluid communication with the supply duct and the return duct, respectively, when the refrigerator door is in a closed position.

12. The ice making assembly of claim 11, wherein an inlet gasket is positioned adjacent the inlet such that the inlet gasket forms a seal with the supply duct when the refrigerator door is in the closed position and an outlet gasket is positioned adjacent the outlet such that the outlet gasket forms a seal with the return duct when the refrigerator door is in the closed position.

13. A refrigerator appliance comprising:

a cabinet defining a chilled chamber;

a door being rotatably mounted to the cabinet to provide selective access to the chilled chamber;

a door liner attached to the door and defining a circulation duct configured for receiving cooled air from a sealed system; and an ice making assembly comprising:

an icebox mounted within the door liner, the icebox defining an ice making chamber and a heat exchanger aperture;

a heat exchanger positioned within the heat exchanger aperture, the heat exchanger comprising a first side positioned within the ice making chamber and a second side positioned outside the ice making chamber such that only the second side of the heat exchanger is in fluid communication with the circulation duct;

an icemaker positioned within the ice making chamber; and a fastener for removably attaching the icemaker to the first side of the heat exchanger.

14. The refrigerator appliance of claim 13, wherein the fastener is passed through the heat exchanger into the icemaker.

15. The refrigerator appliance of claim 13, wherein the ice making assembly comprises two or more fasteners for removably attaching the icemaker to the heat exchanger.

16. The refrigerator appliance of claim 13, wherein the fastener is accessible through the circulation duct.

17. The refrigerator appliance of claim 13, wherein the icemaker defines a mounting surface and the first side of the heat exchanger defines a receiving surface, the receiving surface being complementary to and configured for receiving the mounting surface of the icemaker.

18. The refrigerator appliance of claim 17, wherein a thermally conductive paste is positioned between the mounting surface of the icemaker and the receiving surface of the heat exchanger when the icemaker is in an installed position.

19. The refrigerator appliance of claim 13, wherein the heat exchanger and the icemaker define complementary alignment features for supporting the icemaker while fasteners are inserted.

20. The refrigerator appliance of claim 13, comprising a supply duct and a return duct for circulating cooled airflow through an evaporator chamber of the refrigerator appliance, and wherein the circulation duct defines an inlet and an outlet, the inlet and the outlet being placed in fluid communication with the supply duct and the return duct, respectively, when the refrigerator door is in a closed position.

* * * * *